US009888745B2

(12) United States Patent
Bonnet

(10) Patent No.: US 9,888,745 B2
(45) Date of Patent: Feb. 13, 2018

(54) ICE CRAMPON WITH IMPROVED LONGITUDINAL ADJUSTMENT

(71) Applicant: ZEDEL, Crolles (FR)

(72) Inventor: Guillaume Bonnet, Grenoble (FR)

(73) Assignee: ZEDEL, Crolles (FR)

( * ) Notice: Subject to any disclaimer, the term of this patent is extended or adjusted under 35 U.S.C. 154(b) by 0 days.

(21) Appl. No.: 14/600,565

(22) Filed: Jan. 20, 2015

(65) Prior Publication Data

US 2015/0216265 A1 Aug. 6, 2015

(30) Foreign Application Priority Data

Feb. 6, 2014 (FR) ..... 14 00338

(51) Int. Cl.
*A43C 15/06* (2006.01)

(52) U.S. Cl.
CPC ..... *A43C 15/068* (2013.01); *A43C 15/063* (2013.01); *A43C 15/066* (2013.01)

(58) Field of Classification Search
CPC ..... A43C 15/066; A43C 15/12; A43C 15/14; A43C 15/063; A43C 15/068; A43C 15/161; A43C 15/02; A43C 15/08; A43C 15/10; A43C 15/16; A43C 15/162; A43B 13/28; A43B 5/002; A43B 5/0496; A43B 5/18; A43B 5/001
USPC ..... 36/64, 59 R, 7.6, 7.7, 62, 11.5, 124
See application file for complete search history.

(56) References Cited

U.S. PATENT DOCUMENTS

| | | | | |
|---|---|---|---|---|
| 3,182,407 A | | 5/1965 | Harde | |
| 3,685,173 A | * | 8/1972 | Piazza | A43C 15/068 36/64 |
| 4,005,533 A | * | 2/1977 | Anderson | A43C 15/065 36/62 |
| 4,344,238 A | * | 8/1982 | Peyser | A43C 15/063 36/62 |
| 4,480,396 A | * | 11/1984 | Lowe | A43C 15/068 36/124 |
| 5,359,789 A | * | 11/1994 | Bell | A43C 15/00 36/11.5 |
| 5,950,334 A | * | 9/1999 | Gerhardt | A43B 5/18 36/59 R |

FOREIGN PATENT DOCUMENTS

| | | |
|---|---|---|
| DE | 2264044 A1 | 7/1974 |
| FR | 942119 A | 1/1949 |
| FR | 54745 E | 7/1950 |
| FR | 963617 A | 7/1950 |
| FR | 2457654 A1 | 12/1980 |
| FR | 2509968 A1 | 1/1983 |
| FR | 2575659 A1 | 7/1986 |
| JP | 59-23309 U | 2/1984 |

* cited by examiner

*Primary Examiner* — Alissa Hoey
*Assistant Examiner* — Catherine M Ferreira
(74) *Attorney, Agent, or Firm* — Oliff PLC

(57) ABSTRACT

An ice crampon comprises a metal body composed of a head and a heel connected by flexible connecting means formed by at least one flexible cord after passing through length adjustment notches. These notches form part of a notching system securedly attached to the body of the crampon, so that the longitudinal adjustment of the cord is adapted to the shoe size, independently from the fixing means of the crampon.

6 Claims, 8 Drawing Sheets

ICE CRAMPON WITH IMPROVED LONGITUDINAL ADJUSTMENT

BACKGROUND OF THE INVENTION

The invention relates to an ice crampon comprising a metal body composed of:

- a front part or head and a rear part or heel connected to said head by flexible connecting means collaborating with an adjustment system for adjusting the length of the crampon,
- and fixing means for attaching the crampon to the sole of a shoe.

STATE OF THE ART

The document FR 2,575,659 describes an ice crampon having a head and a heel connected to one another by flexible cables collaborating with a clamping device with a securing buckle. The two cables pass through links of a pair of small chains securedly attached to the heel. Each chain comprises a pin enabling the number of links to be selected for longitudinal adjustment. Closing of the buckle acts on the length of the cables to perform tensioning of the head and of the heel.

The document FR 942119 relates to an ice crampon wherein clamping of the crampon to the shoe is obtained by means of a cable equipped with a tightener. The fixing plate comprises several notches for attaching the head of the cable in order to adjust the length. The cable is in direct mechanical connection with the fixing system.

According to French Patents No 2,509,968 and 2,457,654, the mechanical connection between the head and the heel comprises a rigid metal bar the length of which is adjustable by means of successive holes or notches arranged along the bar. Longitudinal adjustment is performed by selection of a predefined hole or notch according to the required shoe size. Such a head, bar and heel assembly is generally made from steel, which results in it having a certain weight. The presence of a rigid bar moreover increases the overall size when the crampon is stowed in the mountaineer's or rambler's bag.

OBJECT OF THE INVENTION

The object of the invention consists in providing an ice crampon having a moderate weight, that is easy to adjust to the shoe size, and presents a compact volume when stowed away.

The ice crampon according to the invention is characterized in that the flexible connecting means are formed by at least one flexible cord connected between the head and the heel after passing through adjustment notches forming part of a notching system securedly attached to the body of the crampon, the longitudinal adjustment of the cord in said notches being arranged to adapt to the shoe size, independently from the fixing means of the crampon.

According to a preferred embodiment, the cord is configured in the form of two elementary strands laterally spaced apart from one another with respect to the longitudinal mid-axis of the crampon body. The length of the two strands of the cord is adjusted by means of two series of notches arranged along opposite inner edges of the heel or of the head. The presence of the two strands enables a good stability to be obtained between the head and the heel.

According to an advantageous feature of the invention, each series of successive notches forms a rectilinear notching system on each side of the longitudinal mid-axis.

The two strands can originate from a single cord forming a ring after passing through the notches.

The two strands can also be independent from one another, each strand being individually fixed to first attachment points of the heel and to second attachment points of the head after passing through the adjustment notches. The notches can be either integrated in the heel or in the head of the crampon or be arranged on a part added on to the heel or to the head.

The heel or the head of the crampon advantageously comprises at least one crescent-shaped aperture having two adjacent slots for choice of passage of the strands of the cord, enabling adjustment half-notches to be achieved.

According to another feature, the cord comprises a single strand and a single series of notches extending along the longitudinal mid-axis.

Preferably, the flexible cord is made from a textile material having a base formed by polyethylene fibres having a high tensile strength.

BRIEF DESCRIPTION OF THE DRAWINGS

Other advantages and features will become more clearly apparent from the following description of an embodiment of the invention given for non-restrictive example purposes only and represented in the appended drawings, in which.

the two

DETAILED DESCRIPTION OF THE INVENTION

Figure 1:
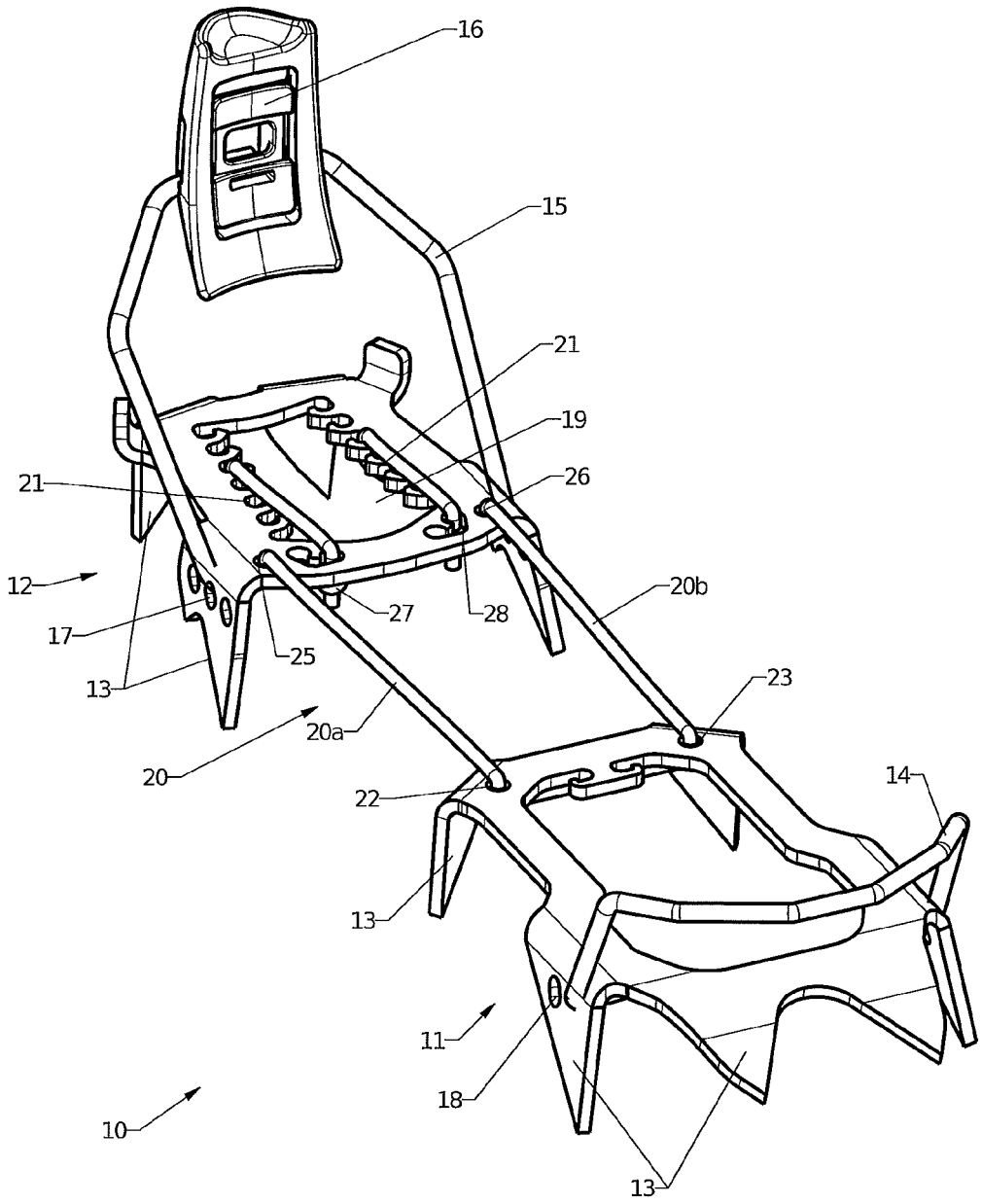
FIG. 1 is a perspective view of a crampon equipped with an adjustable flexible connection according to the invention.
Figure 2:
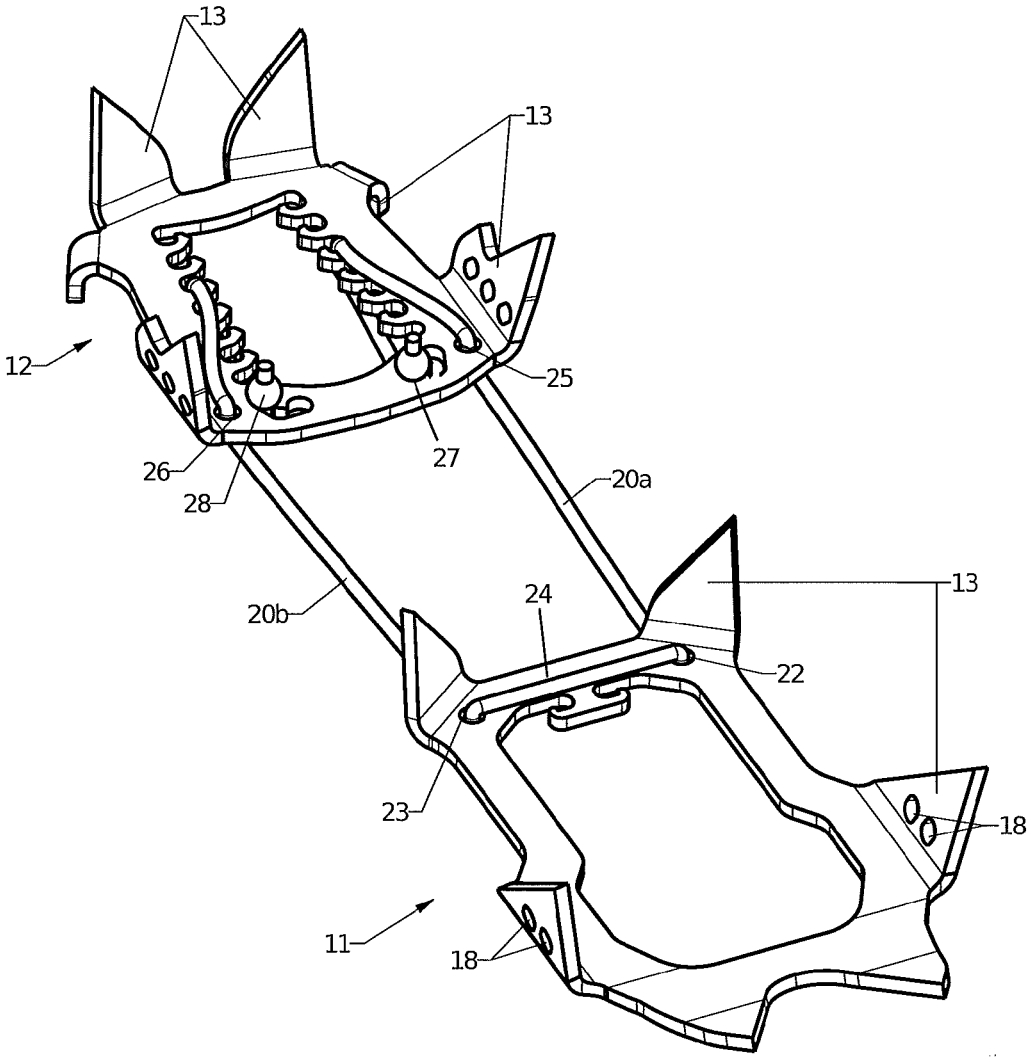
FIG. 2 is a bottom view of FIG. 1, the fixing clamps and the heel-plate not being represented.

With reference to FIGS. 1 and 2, an ice crampon 10 is composed of a front part or head 11 and a rear part or heel 12, the two parts being able to be adjusted to a sole of a mountaineer's shoe. Head 11 and heel 12 are formed by independent parts, each being apertured in its central part, and made from a metallic material, in particular from aluminium or steel. A plurality of sharp teeth 13 designed to penetrate into the ice or hard snow slope extend at the periphery of head 11 and of heel 12. All the teeth 13 are pointed downwards, except for the two horizontal spikes at the front of the head 11.

A first fixing clamp 14 in the form of a cradle is articulated transversely to the front of head 11 to come into engagement with the front edge of the sole of the shoe. A U-shaped second clamp 15 on which a heel-plate 16 is mounted for blocking the rear edge of the sole is articulated on heel 12. U-shaped second clamp 15 is larger than first clamp 14, and its two ends are housed on each side of the heel in one of the holes 17 provided in the two front teeth of heel 12. The ends of first clamp 14 can also be inserted in one of the spaced-apart holes 18 arranged in the lateral teeth 13 of head 11.

Head 11 and heel 12 of crampon 10 are connected to one another by flexible connecting means collaborating with a length adjustment system 19 enabling crampon 10 to be adjusted to the shoe size. The flexible connecting means are formed by a cord 20 configured in the form of two elementary strands 20*a*, 20*b*, laterally spaced apart from one another. Adjustment system 19 comprises two series of notches 21 arranged along opposite inner edges of the apertured part of heel 12, each series constituting a rectilinear notching system on each side of the longitudinal mid-axis of crampon 10.

Flexible cord 20 is preferably made from a textile material having a high tensile strength and a low elongation, for example made from high-tenacity polyethylene fibres of Dyneema type (trademark filed by DSM). It is clear that other materials having a dimensional stability to humidity and an abrasion and cutting resistance can be used.

The two strands 20*a*, 20*b* of FIGS. 1 and 2 originate from a single cord 20 forming a ring after fitting between head 11 and heel 12. At the front, the two strands 20*a*, 20*b* pass through two apertures 22, 23 of head 11 and are transversely joined to one another by a bottom connecting strand 24. At the rear, each strand 20*a*, 20*b* passes through an opening 25, 26 of heel 12 in the downwards direction, and is then engaged in a predefined recess between two notches 21 of the corresponding series, and then comes back upwards to be fixed by its end to an attachment point 27, 28 of heel 12.

Longitudinal adjustment of cord 20 is thus integrated in the metal body of heel 12. The two strands 20*a*, 20*b* simply have to be slackened and the cord be positioned in the required notches 21 according to the shoe size. Final fixing of crampon 10 to the sole of the shoe is then performed by rocking of heel-plate 16. The functions of shoe size adjustment and fixing of the crampon are thus independent from one another.

Figure 3:
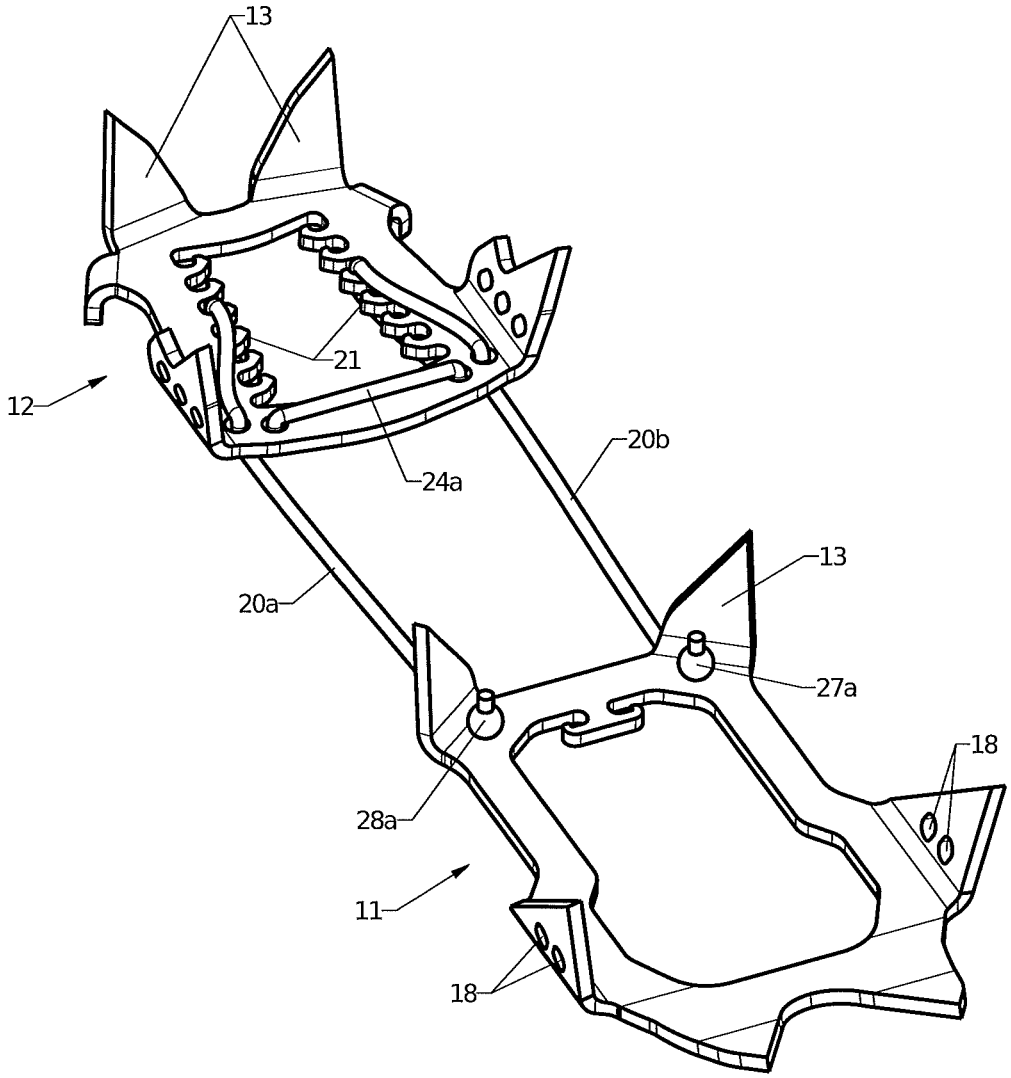
FIGS. 3 to 5 show variants of FIG. 2.

FIG. 3 shows an alternative embodiment of FIG. 2, after inversion of attachment points 27*a*, 28*a* under head 11 and bottom connecting strand 24*a* under heel 12. The rest is similar, in particular the two series of notches 21 of the adjustment system.

Figure 4:
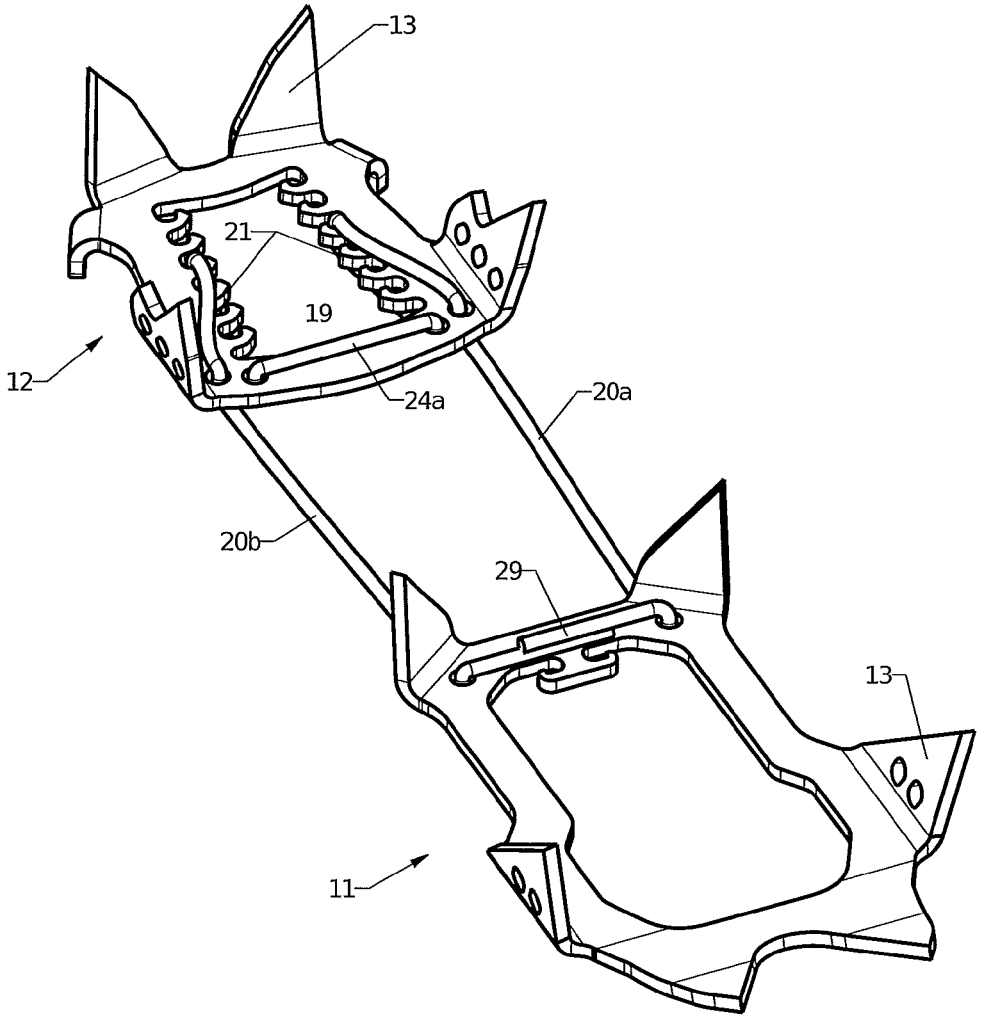

According to the variant of FIG. 4, the two ends of cord 20, instead of being fixed individually to different attachment points of head 11 as in FIG. 3, are connected directly to one another at a common point 29. The rest is identical to FIG. 3.

Figure 5:
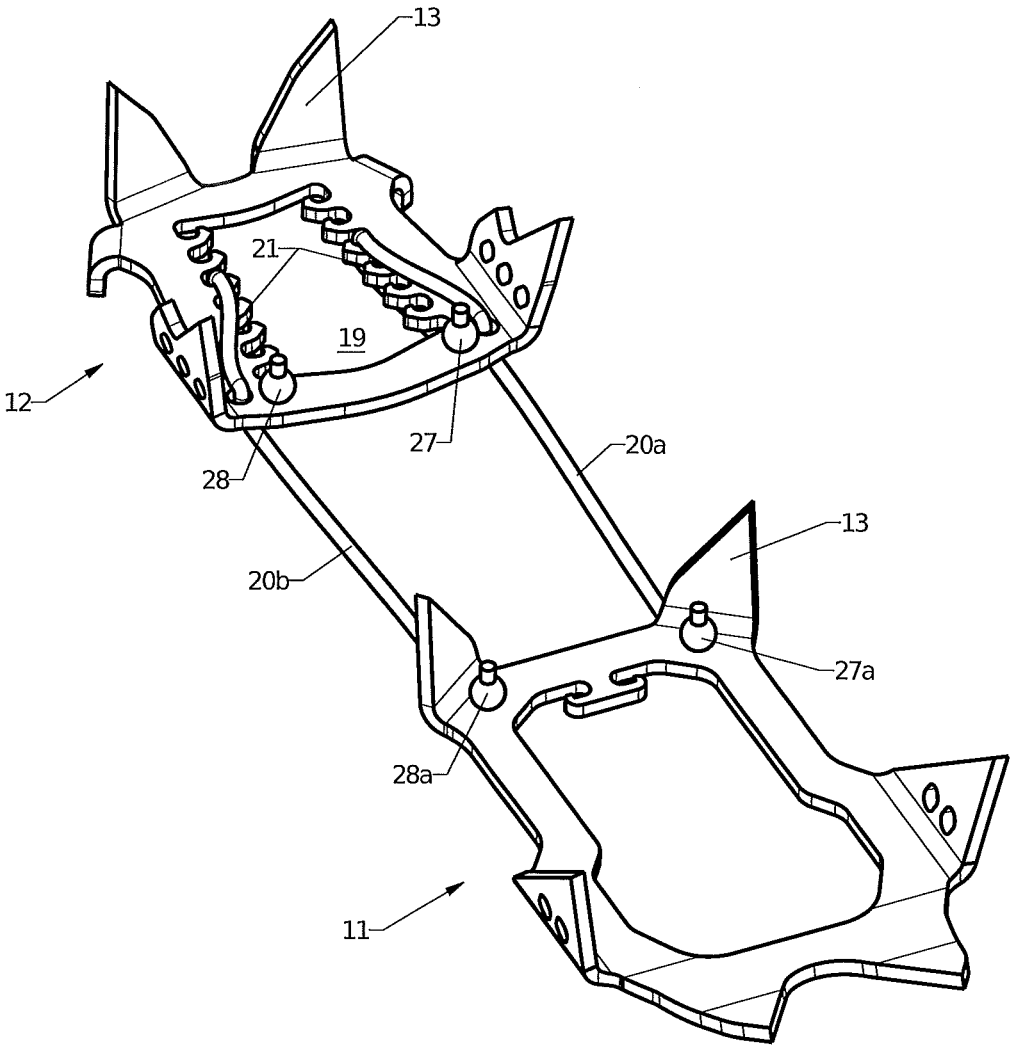

The variant of FIG. 5 represents two cord strands 20*a*, 20*b* independent from one another, instead of a single cord in the form of a ring as in FIGS. 1 to 4. Each strand 20*a*, 20*b* is fixed directly at the front to two attachment points 27*a*, 28*a* of head 11, and to the two attachment points 27, 28 of the heel after passing through the notches 21 of adjustment system 19.

Figure 6:
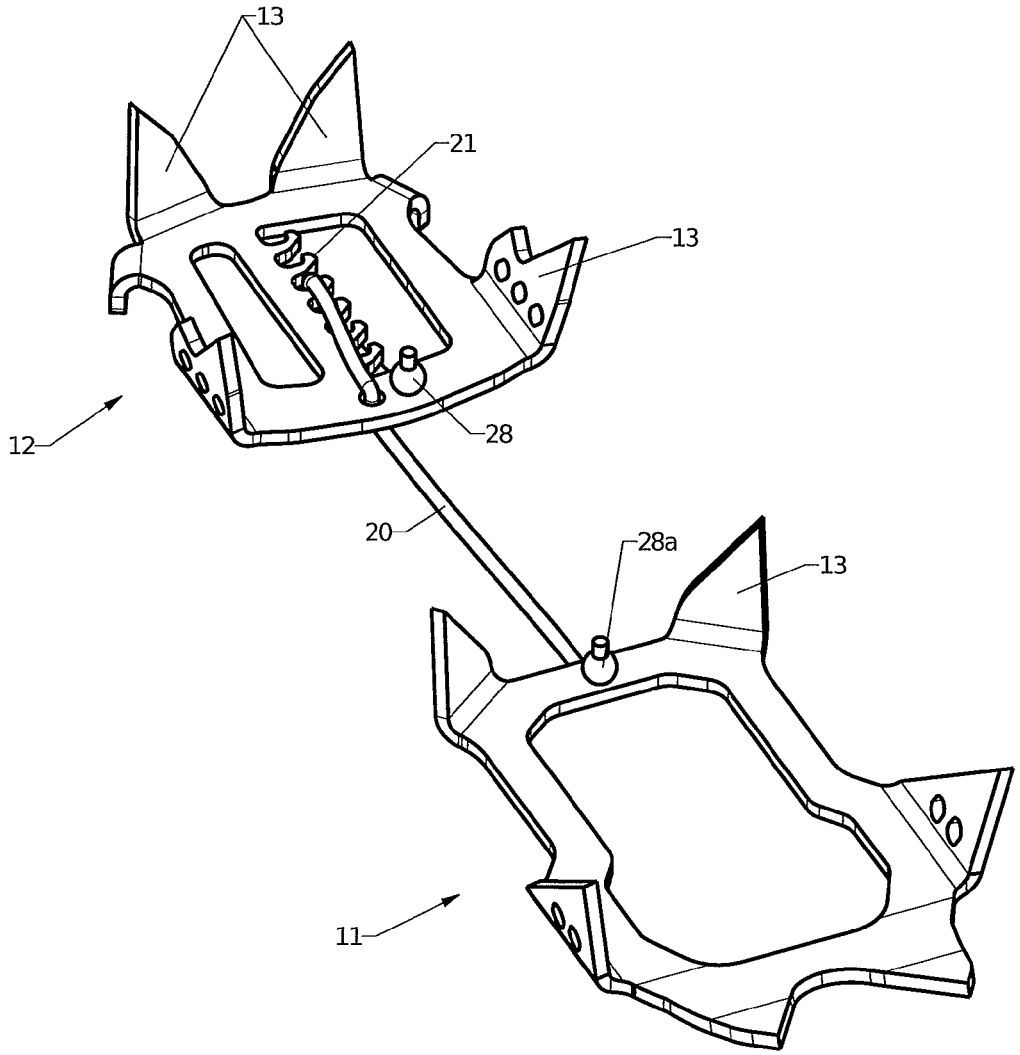
FIG. 6 represents another variant of FIG. 2 with a cord with a single central strand.
Figure 7B:
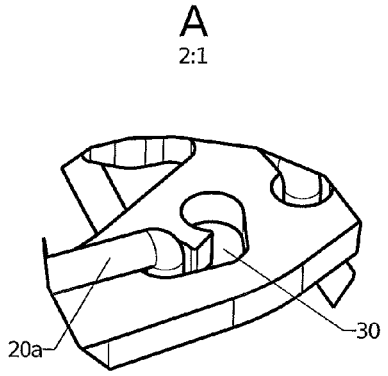
FIGS. 7A and 7B show the openings of the heel for the adjustment half-notches.
Figure 7:
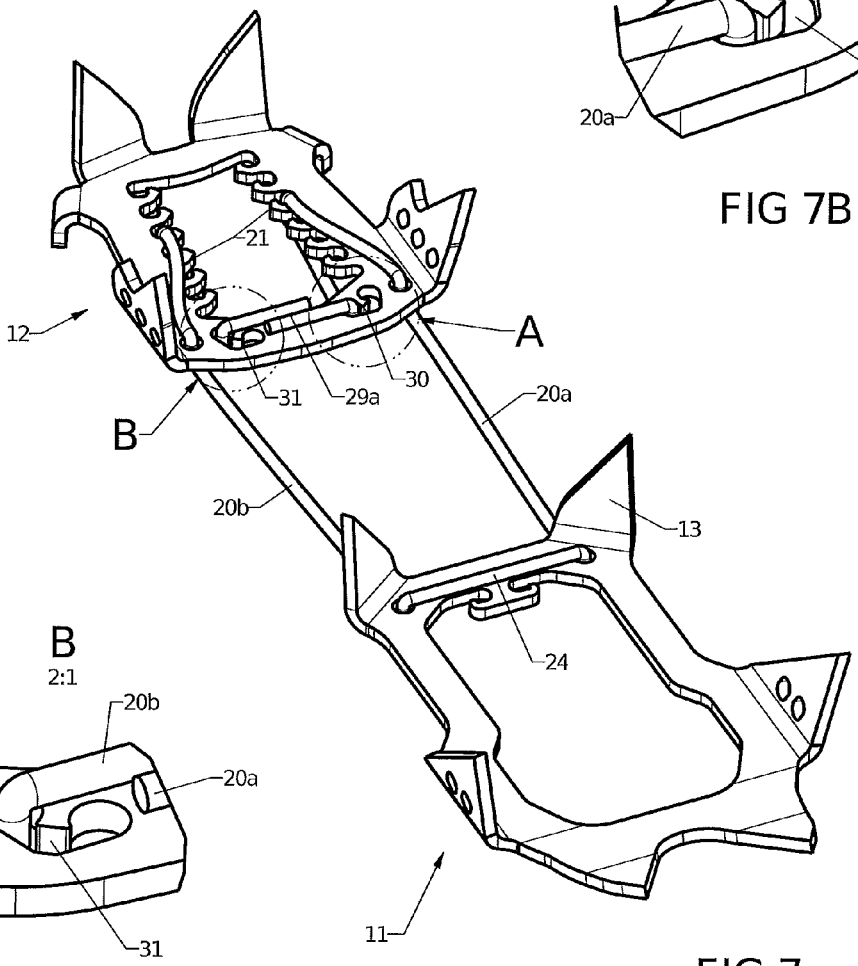
FIG. 7 illustrates another variant of FIG. 4.
Figure 7A:
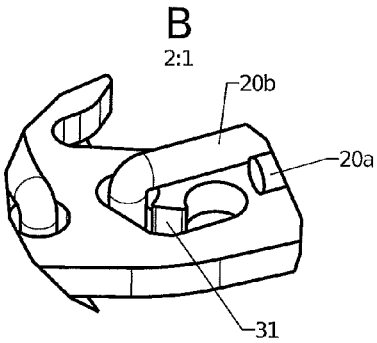

FIG. 6 shows another variant with a single cord strand 20 between head 11 and heel 12, instead of the two strands 20*a*, 20*b* as in FIG. 5. The single cord 20 extends along the longitudinal mid-axis and can be adjusted in length with a single series of notches 21 situated in the central part of heel 12. The ends of cord 20 are fixed to attachment points 28, 28*a* respectively of heel 12 and of head 11.

FIGS. 7, 7A, 7B and 7C illustrate the possibility of achieving fine adjustment of the length of the strands of cord 20*a*, 20*b*. The body of heel 12 comprises for this purpose two crescent-shaped apertures 30, 31 each having two adjacent notches for passage of the ends of strands 20*a*, 20*b*. Adjustment for shoe half-sizes can thus be made.

Figure 8:
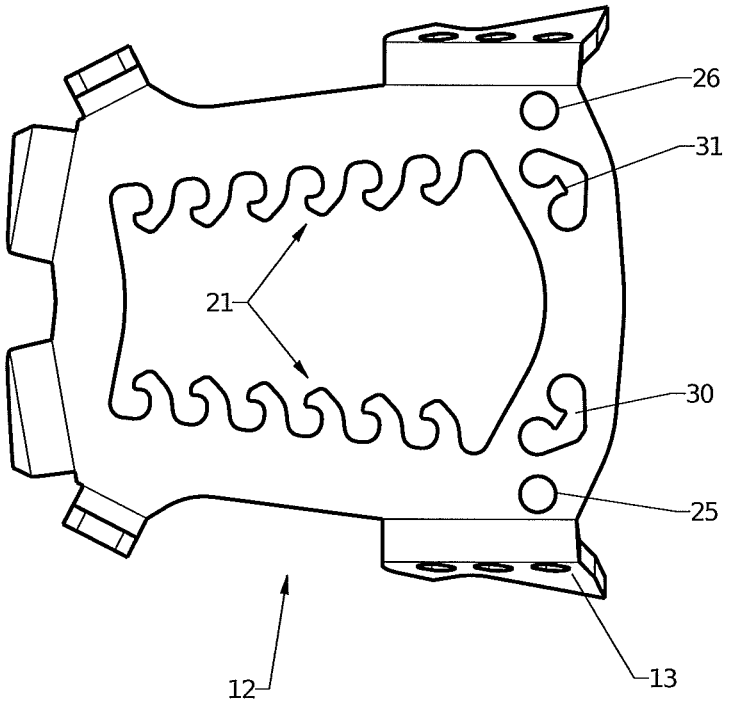
FIG. 8 is a top view of the heel illustrating the two series of notches and the two openings for the adjustment half-notches.

In another embodiment, the ice crampon includes a heel portion containing a center aperture with a lateral edge, a medial edge, an anterior edge and a distal edge; the lateral aperture edge and the medial aperture edge having a plurality of sequential open-ended notches for the engagement of the cord; the notches being angled toward the distal edge of the heel portion aperture, as shown, for example, in FIG. 8.

The invention claimed is:

1. An ice crampon comprising:

a metal body composed of a front part or a head and a rear part or a heel connected together by a flexible cord made from a textile material, passing through a plurality of sequential open-ended adjustment notches for the engagement of the cord and for adjusting the length of the crampon, a first fixing clamp articulated transversely to the front of the head, and a second clamp for blocking a rear edge of the sole of a shoe, wherein the adjustment notches form part of two notching systems with successive notches securedly attached to the rear part, and being independent from said second clamp, wherein the cord is arranged to pass through at least one opening of the rear part, and is then engaged in a predetermined recess between two successive notches of said two notching systems so as to adjust said length, wherein the cord comprises two strands laterally spaced apart from one another with respect to the longitudinal mid-axis of the crampon body, the two notching systems being arranged along opposite inner edges of the heel, and wherein the heel includes a heel portion containing a center aperture with a lateral edge, a medial edge, an anterior edge and a distal edge; the lateral aperture edge and the medial aperture edge having said plurality of sequential open-ended adjustment notches; the notches being angled toward the distal edge of the heel portion aperture.

2. The ice crampon according to claim 1, wherein the two strands originate from a single cord forming a ring after passing through the notches.

3. The ice crampon according to claim 1, wherein the two strands of the cord are independent from one another, each strand being individually fixed to attachment points of the heel and to attachment points of the head after passing through the adjustment notches.

4. The ice crampon according to claim 1, wherein the notches are either integrated in the crampon or arranged on a part added on to the heel.

5. The ice crampon according to claim 1, wherein the heel comprises at least one crescent-shaped aperture having two adjacent notches for choice of passage of the strands of the cord enabling adjustment half-notches to be achieved.

6. The ice crampon according to claim 1, wherein the textile material is formed by high-tenacity polyethylene fibres having a high tensile strength.

* * * * *